US011745911B2

(12) United States Patent
Cohen

(10) Patent No.: US 11,745,911 B2
(45) Date of Patent: Sep. 5, 2023

(54) PRODUCT PACKAGE HAVING FINISHED EDGES AND CAVITIES

(71) Applicant: Knoll Printing & Packaging, Inc., Syosset, NY (US)

(72) Inventor: Jeremy Cohen, Syosset, NY (US)

(73) Assignee: Knoll Printing & Packaging, Inc., Syosset, NY (US)

( * ) Notice: Subject to any disclaimer, the term of this patent is extended or adjusted under 35 U.S.C. 154(b) by 403 days.

(21) Appl. No.: 17/208,259

(22) Filed: Mar. 22, 2021

(65) Prior Publication Data

US 2022/0242609 A1 Aug. 4, 2022

Related U.S. Application Data

(60) Provisional application No. 63/144,574, filed on Feb. 2, 2021.

(51) Int. Cl.
*B65D 5/50* (2006.01)
*B31B 120/30* (2017.01)
(Continued)

(52) U.S. Cl.
CPC ..... *B65D 5/5038* (2013.01); *B31B 50/26* (2017.08); *B31B 2105/00* (2017.08); *B31B 2120/25* (2017.08); *B31B 2120/302* (2017.08)

(58) Field of Classification Search
CPC ..... B65D 73/00; B65D 73/0035; B65D 73/0007; B65D 73/0042; B65D 73/0078; B65D 73/0092; B65D 75/28; B65D 75/30; B65D 75/32; B65D 75/321; B65D 75/322; B65D 75/323; B65D 75/325; B65D 75/326; B65D 75/327; B65D 75/36; B65D 5/5038; B65D 5/5035; B65D 5/5028; B65D 5/50;
(Continued)

(56) References Cited

U.S. PATENT DOCUMENTS 3,587,848 A * 6/1971 Froehlig ..... B65D 73/0092 206/462
6,527,123 B1 3/2003 Ausaf
(Continued)

FOREIGN PATENT DOCUMENTS

WO 2016/120838 A1 8/2016
WO 2018/002791 A1 1/2018
WO 2018/002795 A1 1/2018

OTHER PUBLICATIONS

Notification of Transmittal of the International Search Report and the Written Opinion of the International Search Authority, or the Declaration in PCT/US2022/013618 dated Apr. 5, 2022.

*Primary Examiner* — Javier A Pagan
(74) *Attorney, Agent, or Firm* — Collard & Roe, P.C.

(57) ABSTRACT

A package includes board platform having a folded top platform element and bottom platform element made from cardboard material. The top platform element has cutout portions conforming to shapes of a product to be packaged. A folded cardboard product tray element forms an open cavity conforming to the shape of the product and is secured to at least one of the top platform element and the bottom platform element and is disposed therebetween. A paper platform wrapper covers the exterior surfaces of the top platform element and a paper product tray wrapper covers the interior side wall of the open cavity.

14 Claims, 3 Drawing Sheets

(51) Int. Cl.
*B31B 50/26* (2017.01)
*B31B 120/25* (2017.01)
*B31B 105/00* (2017.01)

(58) Field of Classification Search
CPC ..... B31B 50/26; B31B 2105/00; B31B 2120/302; B31B 2120/25
See application file for complete search history.

(56) References Cited

U.S. PATENT DOCUMENTS

| | | | | |
|---|---|---|---|---|
| 7,549,537 | B2 | 6/2009 | Hsu | |
| 8,684,182 | B2 * | 4/2014 | Bailey | B65D 73/0007 206/463 |
| 10,384,827 | B1 * | 8/2019 | Mehta | B65D 5/5038 |
| 2008/0197043 | A1 | 8/2008 | Freeze et al. | |
| 2010/0084300 | A1 * | 4/2010 | Hession | G09F 1/06 206/462 |
| 2014/0216970 | A1 * | 8/2014 | Mattiucci | B65D 75/36 206/471 |
| 2018/0044054 | A1 | 2/2018 | Saito | |

* cited by examiner

PRODUCT PACKAGE HAVING FINISHED EDGES AND CAVITIES

CROSS REFERENCE TO RELATED APPLICATIONS

This application claims priority under 35 U.S.C. § 119(e) and the benefit of U.S. Provisional Application No. 63/144,574 filed on Feb. 2, 2021, the disclosure of which is hereby incorporated by reference in its entirety.

BACKGROUND OF THE INVENTION

Field of the Invention

The invention relates to a product package including a tray provided with one or more cavities shaped and dimensioned to hold a product or products and a method for manufacturing such package.

The Prior Art

Various packages are known for containing products. It is known to provide a package having one or more open cavities conforming to a shape of a product to be packaged therein. There exists a need, however, for a package having one or more cavities to hold a product, which package features finished edges and cavities and provides a seamlessly wrapped assembly having a finished, upscale appearance.

SUMMARY OF THE INVENTION

The invention relates to a product package including a tray provided with one or more cavities shaped and dimensioned to hold a product or products and a method for manufacturing such package.

A method for manufacturing a package according to an aspect of the invention includes the step of providing a board platform including a flat top platform element made from a cardboard material and a separate flat bottom platform element made from a cardboard material. Each of the flat top platform element and the separate flat bottom platform element have a plurality of respective side portions. The flat top platform element has one or more cutout portions conforming to one or more shapes of a product or products to be packaged.

The method further includes the step of providing one or more flat product tray elements made from a cardboard material. The flat product tray element is shaped and dimensioned such that when folded, the product tray element forms an open cavity conforming to the shape of a product to be packaged.

The method further includes the step of providing a wrapper made from a paper material. The wrapper includes a platform wrapper conforming to the shape and dimensions of the flat top platform element and a product tray wrapper conforming to the dimensions of an interior side wall of the open cavity formed by the product tray element.

The method further includes the steps of folding the flat product tray element to form the open cavity conforming to the shape of the product to be packaged and folding the plurality of respective side portions of the flat top platform element and the separate flat bottom platform element to form respective box shapes.

The method further includes the steps of securing the folded product tray element forming the open cavity to at least one of the top platform element and the bottom platform element and assembling the top platform element and the bottom platform element to enclose the folded product tray element forming the open cavity between the top platform element and the bottom platform element.

The method further includes the steps of wrapping the interior side wall of the open cavity formed by the product tray element with the product tray wrapper and wrapping the exterior surfaces of the top platform element with the platform wrapper.

According to a further aspect of the invention, the flat product tray element includes a first product tray element and a second product tray element which are shaped and dimensioned such that when folded and assembled together, the first product tray element and the second product tray element together form an open cavity conforming to the shape of the product to be packaged.

According to a further aspect of the invention, the flat product tray element includes a plurality of flat product tray elements, each of which is shaped and dimensioned such that when folded, the respective product tray element forms an open cavity conforming to a respective shape of a respective product to be packaged.

According to a further aspect of the invention, a surface of the folded product tray element forming the open cavity is adhesively secured to a surface of the top platform element at the corresponding cutout.

According to a further aspect of the invention, a surface of the folded product tray element forming the open cavity is adhesively secured to a surface of the lower platform element.

According to a further aspect of the invention, a flat product pad made from a cardboard material is provided, is folded to form a box shape and the folded product pad is secured to the lower platform element.

A package according to an aspect of the invention includes a board platform having a top platform element made from a cardboard material and a bottom platform element made from a cardboard material. Each of the top platform element and the bottom platform element have a plurality of respective side portions. The top platform element has one or more cutout portions conforming to one or more shapes of a product or products to be packaged.

The package further includes one or more product tray elements made from a cardboard material. The product tray element is shaped and dimensioned to form an open cavity conforming to the shape of the product to be packaged. The product tray element is secured to at least one of the top platform element and the bottom platform element and is disposed between the top platform element and the bottom platform element;

The package further includes a platform wrapper conforming to the shape and dimensions of the top platform element and covering the exterior surface of the top platform element and a product tray wrapper conforming to the dimensions of an interior side wall of the open cavity formed by the product tray element and covering the interior side wall of the open cavity.

An advantage of a package and method according to embodiments of the invention is the provision of a package made completely from cardboard and paper, which package is recyclable and sustainable. Another advantage of a package and method according to embodiments of the invention is the provision of a package featuring all finished edges and cavities which package is seamlessly wrapped assembly and has a finished, upscale appearance. The method of wrapping and assembly may result, for example in no exposed edges of cardboard greater than 0.25 mm, and the finished appearance of the tray is such that it fits uniquely shaped products with no or only extremely small exposed edges in the product cavity of the tray.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
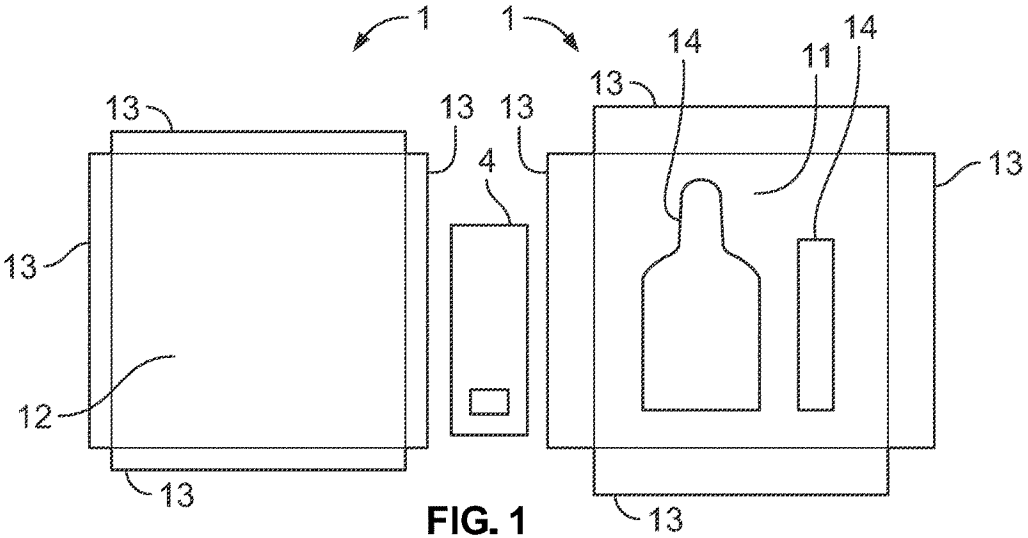
FIG. 1 shows a flat top platform element, a flat bottom platform element and flat product pad prior to folding and assembly.
Figure 13:
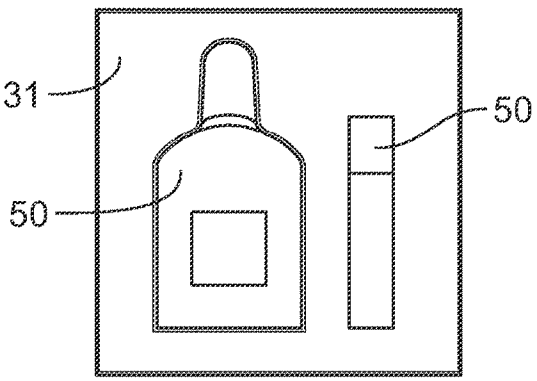
FIG. 13 shows the finished package of FIG. 12 with products situated therein.

Referring now in detail to the drawings, and in particular FIG. 1, a package is manufactured by providing a board platform 1. The board platform 1 includes an initially a flat top platform element 11 made from a cardboard material and a separate initially flat bottom platform element 12 made from a cardboard material. Each of the flat top platform element 11 and the separate flat bottom platform element 12 have a plurality of respective side portions 13 which can be folded to form a box-shaped component. The flat top platform element 11 has one or more cutout portions 14 conforming to one or more shapes of a product or products 50 (FIG. 13) to be packaged. The product 50 may be, for example, a bottle of perfume or a bottle containing an alcoholic beverage or any product suitable to be packaged in a package according to the invention.

Figure 2:
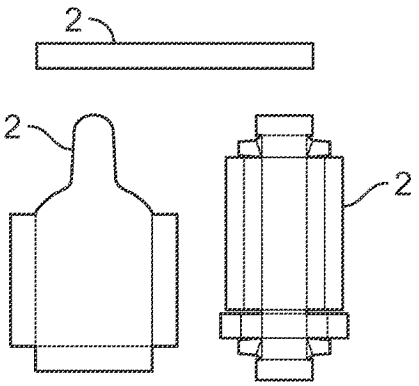
FIG. 2 shows components of flat product trays prior to folding and assembly.

As shown in FIG. 2, one or more initially flat product tray elements 2 made from a cardboard material are provided. The flat product tray elements 2 are shaped and dimensioned such that when folded, the product tray element 2 forms an open cavity 21 or well conforming to the shape of a product 50 to be received in the cavity 50 packaged.

Figure 4:
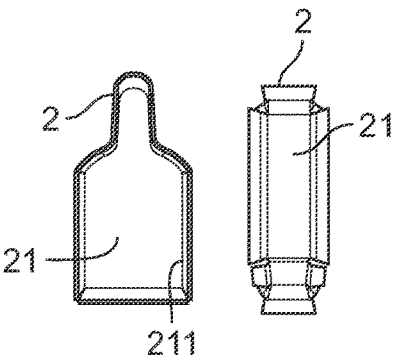
FIG. 4 shows the product trays of FIG. 2 in a folded and assembled condition.
Figure 3:
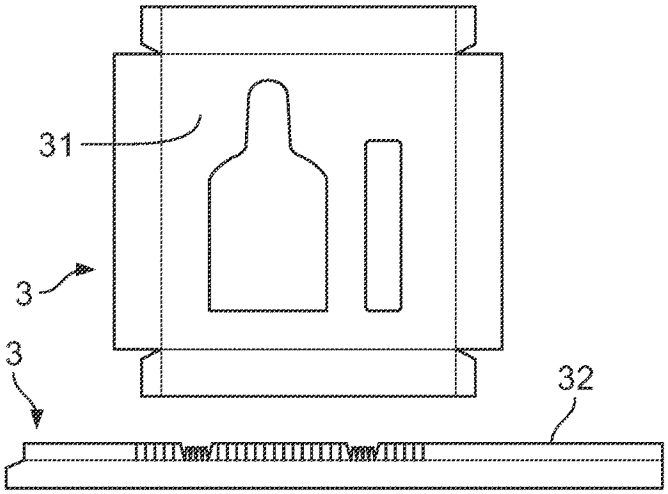
FIG. 3 shows a platform wrapper and a product tray wrapper prior to folding and assembly.

As shown in FIG. 3, a wrapper 3 is provided. The wrapper 3 may be made from a paper material. The wrapper 3 includes a platform wrapper 31 conforming to the shape and dimensions of the flat top platform element 11, including the one or more cutout portions 14 and a product tray wrapper 32 conforming to the dimensions of an interior side wall 211 (FIG. 4) of the open cavity 21 formed by the product tray element 2.

The flat product tray element or elements 2 are folded to form the open cavity 21 conforming to the shape of the product 50 to be packaged. The respective side portions 13 of the flat top platform element 11 and the separate flat bottom platform element 12 are folded to form respective box shapes.

Figure 8:
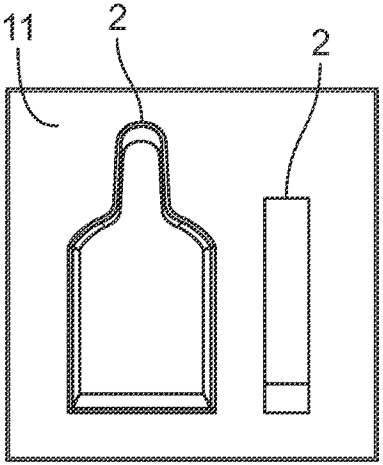
FIG. 8 shows the top platform element, product trays and bottom platform element in a folded and assembled condition.
Figure 5:
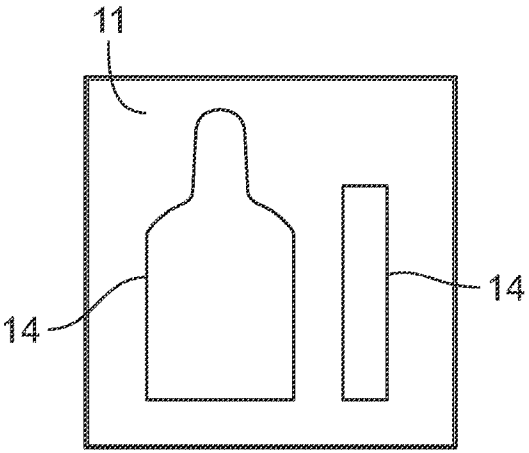
FIG. 5 shows the top platform element of FIG. 1 in a folded condition.
Figure 7:
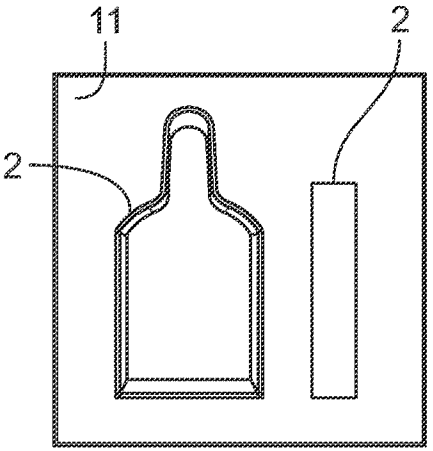
FIG. 7 shows the top platform element and product trays in a folded and assembled condition.
Figure 11:
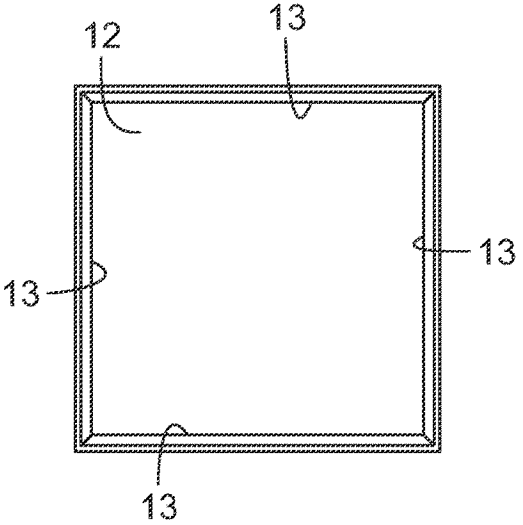
FIG. 11 shows the bottom platform element in a folded condition.

The folded product tray element 2 forming the open cavity is secured to at least one of the top platform element 11 and the bottom platform element 12 and the top platform element 11 and bottom platform element 12 are assembled to enclose the folded product tray element 2 between the top platform element 11 and the bottom platform element 12. For example, surface of the folded product tray element 2 forming the open cavity 21 may be adhesively secured to a surface of the top platform element 11 at a corresponding cutout 14 or a surface of the folded product tray element 2 forming the open cavity 21 may be adhesively secured to a surface of the lower platform element 12. An exemplary assembly of the top platform element 11 and bottom platform element 12 with folded product tray elements 2 enclosed therebetween is shown in FIG. 8.

Figure 9:
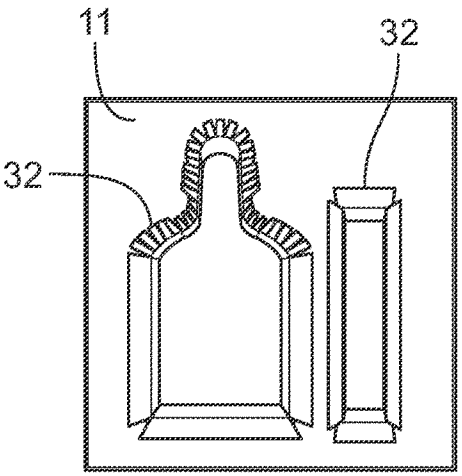
FIG. 9 shows the product trays being wrapped with the product tray wrappers.
Figure 10:
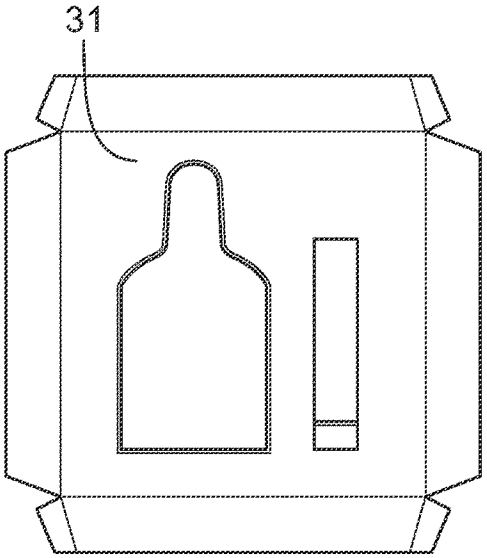
FIG. 10 shows a platform wrapper.
Figure 12:
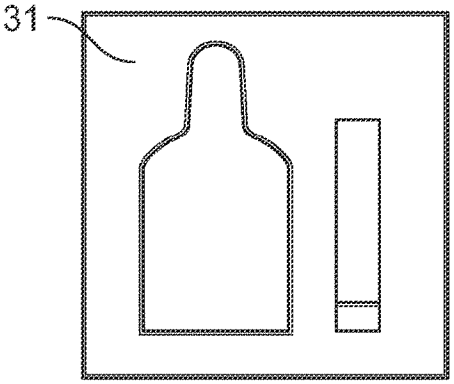
FIG. 12 shows a finished package.

The interior side wall 211 of the open cavity 21 formed by the product tray element 2 is wrapped or covered with the product tray wrapper 32 as shown, for example in FIG. 9. The product tray wrapper 32 may, for example have a length conforming to the perimeter of the cavity 21 and a foldable top portion which is folded over a top surface of the assembled top platform element 11 and may be secured thereto. Exterior surfaces of the top platform element 11 are then wrapped or covered with the platform wrapper 31. As shown in FIGS. 10 and 12, the platform wrapper 31 may have foldable side portions which are folded over the corresponding side portions 13 of top platform element 11 and may be secured thereto.

As shown in FIG. 2, the product tray element may include multiple product tray elements which are folded and assembled together to form a single open cavity 21 conforming to the shape of the product 50 to be packaged. A plurality of flat product tray elements 2 may be provided with different shapes and dimensions adapted to form respective open cavities conforming to products having different shapes and sizes.

Figure 6:
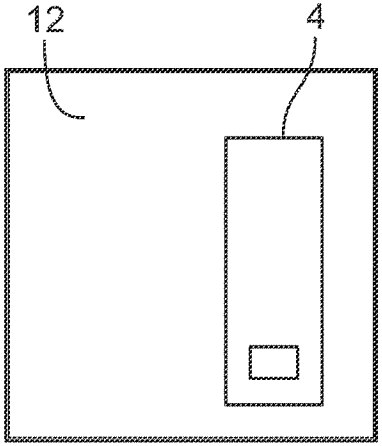
FIG. 6 shows the bottom platform element and product pad of FIG. 1 in a folded and assembled condition.

A flat product pad 4 made from a cardboard material may be provided as well. The flat product pad 4 is folded to form a box shape and the folded product pad 4 is secured to the lower platform element 4 (FIG. 6).

A package according to an aspect of the invention includes a board platform 1 having a top platform element 11 made from a cardboard material and a bottom platform element 12 made from a cardboard material. Each of the top platform element 11 and the bottom platform element 12 have a plurality of respective side portions 13. The top platform element 11 has one or more cutout portions 14 conforming to one or more shapes of a product or products 50 to be packaged.

The package further includes one or more product tray elements 2 made from a cardboard material. The product tray element 2 is shaped and dimensioned to form an open cavity 21 conforming to the shape of the product 50 to be packaged. The product tray element 2 may include multiple pieces which are folded and/or assembled together to form the open cavity 21 or well. The product tray element or elements 2 are secured to one or both of the top platform element 11 and the bottom platform element 12 and are disposed between the top platform element 11 and the bottom platform element 12

The package further includes a platform wrapper 31 conforming to the shape and dimensions of the top platform element 11 and covering the exterior surface of the top platform element 11 which may include the side portions thereof. The package further includes a product tray wrapper 31 conforming to the dimensions of an interior side wall 211 of the open cavity 21 formed by the product tray element 2 and covering the interior side wall 211 of the open cavity 21. The platform wrapper and the product tray wrapper are preferably made of a paper material.

By manufacturing the package completely from cardboard and paper, a package which is recyclable and sustainable is achieved. Moreover, package and method according to embodiments of the invention includes all finished edges and cavities and is seamlessly wrapped, which result in a finished, upscale appearance suitable for luxury goods.

Although a number of embodiments of the present invention have been shown and described, it is obvious that many changes and modifications may be made thereunto without departing from the spirit and scope of the invention.

What is claimed is:

1. A method for manufacturing a package, the method comprising the steps of:

providing a board platform, the board platform comprising a flat top platform element made from a cardboard material and a separate flat bottom platform element made from a cardboard material, each of the flat top platform element and the separate flat bottom platform element having a plurality of respective side portions, wherein the flat top platform element has a cutout portion conforming to a shape of a product to be packaged;

providing a flat product tray element made from a cardboard material, wherein the flat product tray element is shaped and dimensioned such that when folded, the product tray element forms an open cavity conforming to the shape of the product to be packaged;

providing a wrapper made from a paper material, the wrapper comprising a platform wrapper conforming to the shape and dimensions of the flat top platform element and a product tray wrapper conforming to the dimensions of an interior side wall of the open cavity formed by the product tray element;

folding the flat product tray element to form the open cavity conforming to the shape of the product to be packaged;

folding the plurality of respective side portions of the flat top platform element and the separate flat bottom platform element to form respective box shapes;

securing the folded product tray element forming the open cavity to at least one of the top platform element and the bottom platform element;

assembling the top platform element and the bottom platform element and enclosing the folded product tray element forming the open cavity between the top platform element and the bottom platform element;

wrapping the interior side wall of the open cavity formed by the product tray element with the product tray wrapper; and wrapping the exterior surfaces of the top platform element with the platform wrapper.

2. The method according to claim 1, wherein the step of providing a flat product tray element made from a cardboard material, comprises providing a first product tray element and a second product tray element, wherein the first product tray element and the second product tray element are shaped and dimensioned such that when folded and assembled together, the first product tray element and the second product tray element together form an open cavity conforming to the shape of the product to be packaged.

3. The method according to claim 1, wherein the flat top platform element has a plurality of cutout portions conforming to at least one shape of at least one product to be packaged.

4. The method according to claim 3, wherein the step of providing a flat product tray element made from a cardboard material, comprises providing a plurality of flat product tray elements, wherein each of the plurality of flat product tray element is shaped and dimensioned such that when folded, the respective product tray element forms an open cavity conforming to a respective shape of a respective product to be packaged.

5. The method according to claim 1, wherein the step of securing the folded product tray element forming the open cavity to at least one of the top platform element and the bottom platform element comprises adhesively securing a surface of the folded product tray element forming the open cavity to a surface of the top platform element at the cutout portion.

6. The method according to claim 1, wherein the step of securing the folded product tray element forming the open cavity to at least one of the top platform element and the bottom platform element comprises adhesively securing a surface of the folded product tray element forming the open cavity to a surface of the lower platform element.

7. The method according to claim 1, further comprising the steps of providing a flat product pad made from a cardboard material; folding the product pad to form a box shape; and securing the folded product pad to the lower platform element.

8. A package comprising:

a board platform, comprising a top platform element made from a cardboard material and a bottom platform element made from a cardboard material, each of the top platform element and the bottom platform element having a plurality of respective side portions, wherein the top platform element has a cutout portion conforming to a shape of a product to be packaged;

a product tray element made from a cardboard material, the product tray element being shaped and dimensioned to form an open cavity conforming to the shape of the product to be packaged, wherein the product tray element is secured to at least one of the top platform element and the bottom platform element and is disposed between the top platform element and the bottom platform element;

a platform wrapper conforming to the shape and dimensions of the top platform element and covering exterior surfaces of the top platform element; and a product tray wrapper conforming to the dimensions of an interior side wall of the open cavity formed by the product tray element and covering the interior side wall of the open cavity.

9. The package according to claim 8, wherein the product tray element comprises a plurality of product tray elements which are folded and assembled together to form the open cavity conforming to the shape of the product to be packaged.

10. The package according to claim 8, wherein the top platform element has a plurality of cutout portions conforming to at least one shape of at least one product to be packaged.

11. The package according to claim 8, wherein the product tray element comprises a plurality of product tray elements, wherein each of the plurality of product tray elements is shaped and dimensioned to form an open cavity conforming to a respective shape of a respective product to be packaged.

12. The package according to claim 8, wherein the product tray element forming the open cavity is adhesively secured to a surface of the top platform element at the cutout portion.

13. The package according to claim 8, wherein the product tray element forming the open cavity is adhesively secured to a surface of the lower platform element.

14. The package according to claim 8, further comprising a box-shaped product pad secured to the lower platform element.

* * * * *